US005188181A

United States Patent [19]

Brammer et al.

[11] Patent Number: 5,188,181

[45] Date of Patent: Feb. 23, 1993

[54] ANNULUS SHUTOFF DEVICE FOR A SUBSEA WELL

[75] Inventors: Norman Brammer, Fyvie Turiff, Scotland; Philippe C. Nobileau, Paris, France

[73] Assignee: ABB Vetco Gray Inc., Houston, Tex.

[21] Appl. No.: 811,518

[22] Filed: Dec. 20, 1991

[51] Int. Cl.[5] ..... E21B 33/14; E21B 43/10

[52] U.S. Cl. ..... 166/344; 166/332; 166/368

[58] Field of Search ..... 166/344, 348, 368, 285, 166/332, 242, 208

[56] References Cited

U.S. PATENT DOCUMENTS 4,781,387 11/1989 Braugh ..... 166/348 X
4,848,457 7/1989 Lilley ..... 166/332 X
5,040,606 8/1991 Hopper ..... 166/332

*Primary Examiner*—Terry Lee Melius
*Attorney, Agent, or Firm*—James E. Bradley

[57] ABSTRACT

A subsea well assembly utilizes outer, intermediate, and inner wellhead housings. The inner wellhead housing has a port extending through it that communicates the annulus with the bore of the inner wellhead housing. A sleeve mounts to the inner wellhead housing for opening and closing the port. The port allows the operator to cement a string of inner casing, with returns flowing through the port and back up the bore of the inner wellhead housing.

13 Claims, 2 Drawing Sheets

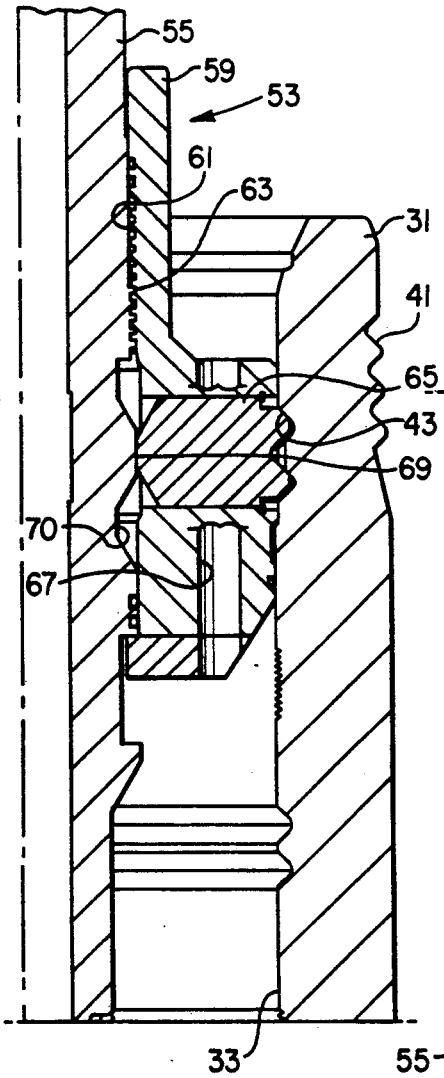
FIG. 1a
FIG. 1b
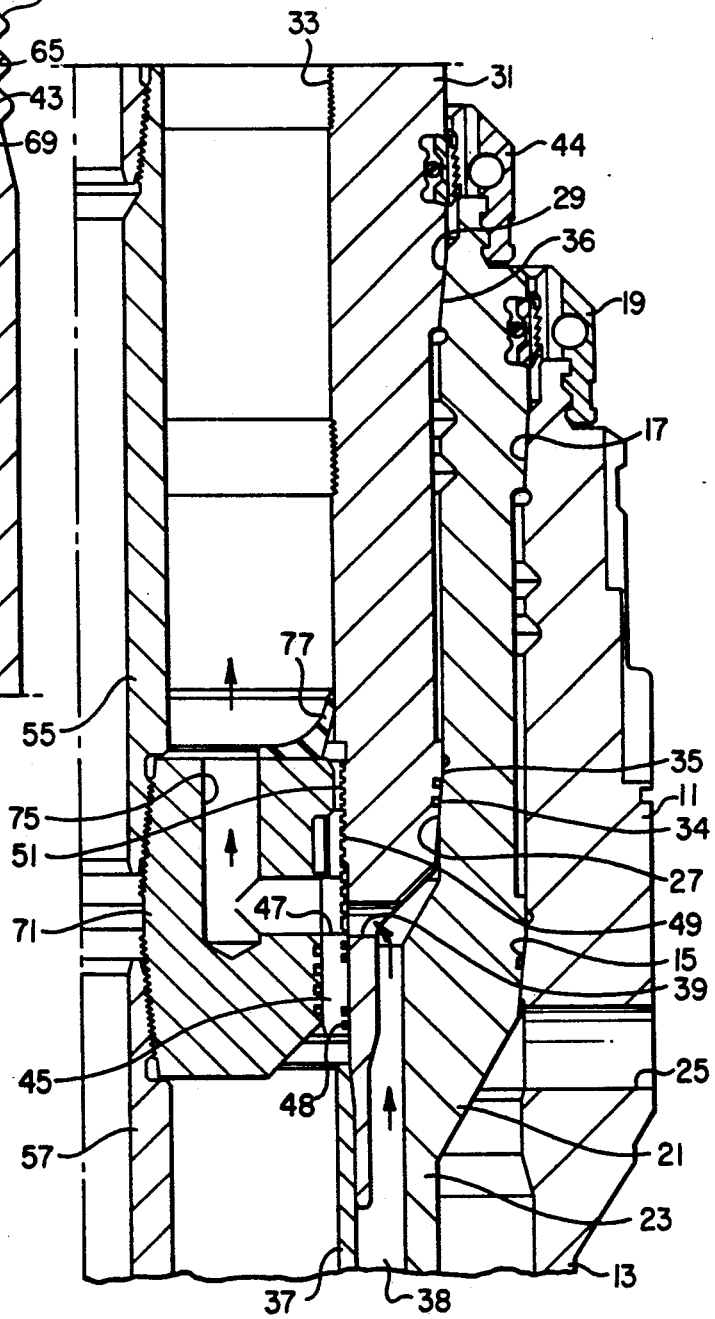

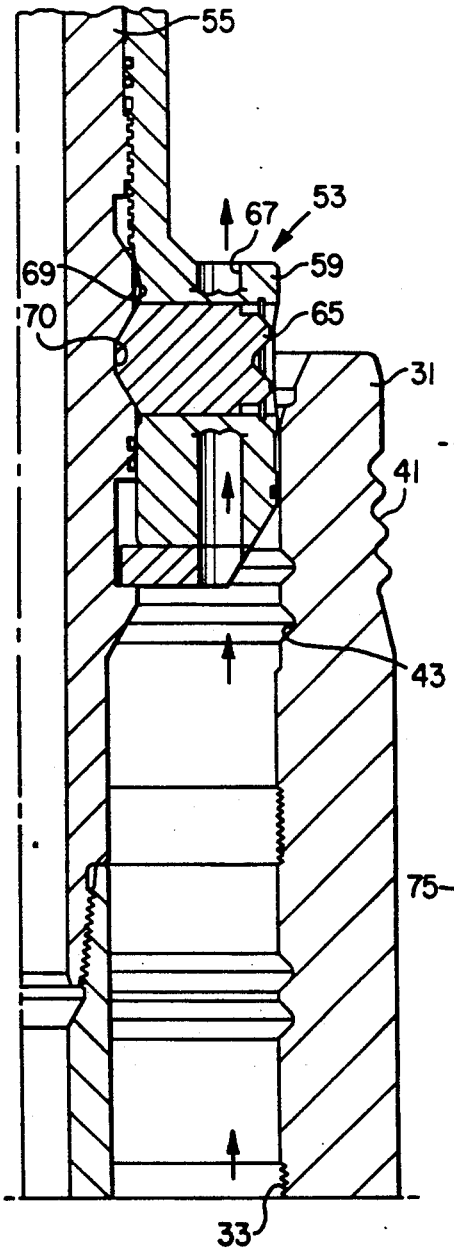
FIG. 2a
FIG. 2b
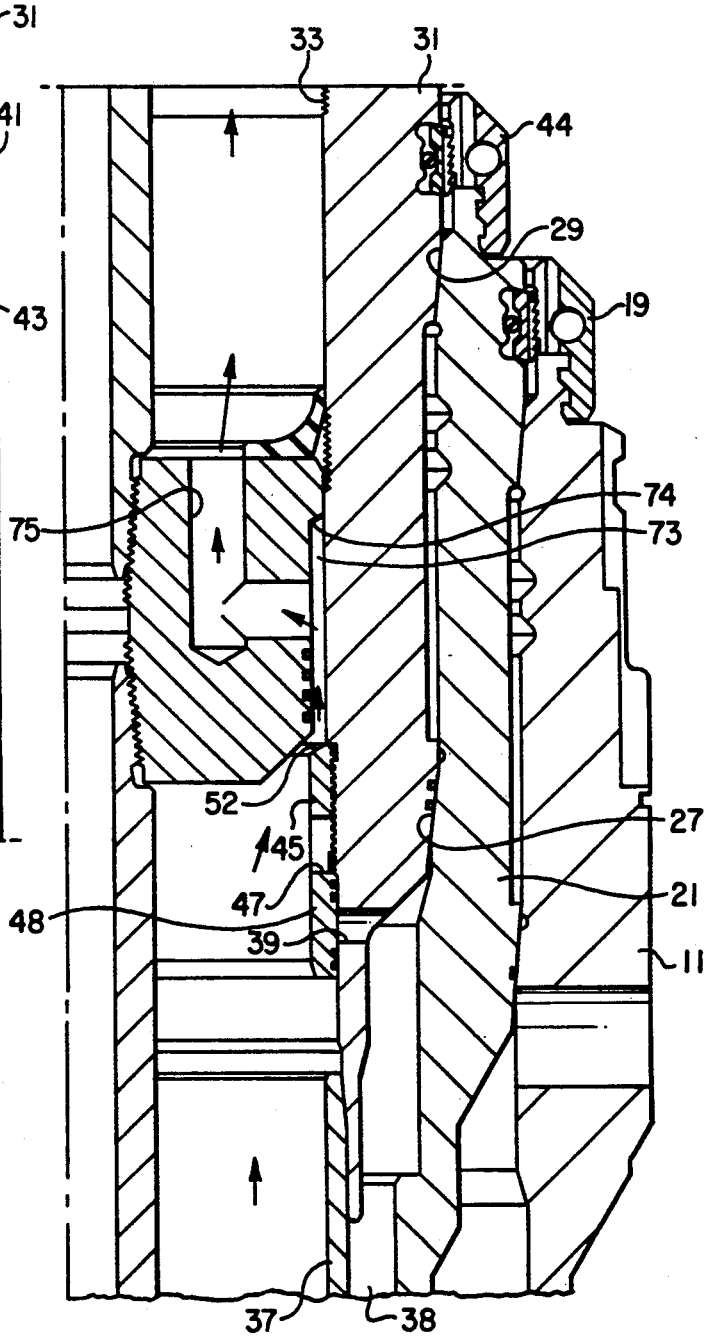

ANNULUS SHUTOFF DEVICE FOR A SUBSEA WELL

BACKGROUND OF THE INVENTION

1. Field of the invention

This invention relates in general to subsea wells, and in particular to a subsea well assembly having inner, outer, and intermediate wellhead housings, with a port and sleeve for exposing the annulus surrounding the inner wellhead housing for cementing.

2. Description of the Prior Art

One type of subsea well installation utilizes an outer or low pressure wellhead housing that locates on the sea floor. The outer wellhead housing is a large tubular member secured to the upper end of an outer string of casing or conductor pipe. The outer casing will extend to a certain depth in the well, and will normally be cemented in place.

Then, the operator lowers a high pressure wellhead housing into the outer wellhead housing. The high pressure wellhead housing is connected to the upper end of a string of casing that extends through the conductor pipe to a greater depth in the well. The operator pumps cement down the inner casing, which flows back up the annulus between the inner casing and the conductor pipe. The cement returns pass through ports located in the outer wellhead housing.

Then, the operator will drill the well to a further depth. The operator lowers a casing hanger which lands in the interior of the high pressure wellhead housing. The casing hanger secures to a string of casing that extends through the inner casing to a greater depth. This inner casing will be cemented in place. Cement returns flow up the annulus surrounding the innermost string of casing and pass through flowby slots located on the exterior of the casing hanger. A seal will then be placed in an annulus space between the casing hanger and high pressure wellhead housing. Subsequently the operator may complete the well with tubing. Or the operator may drill to even greater depths and support additional casing hangers and strings of casing in the high pressure wellhead housing.

One reason for using multiple strings of different diameter in a well is to protect low pressure water zones in the earth's formation. Hydrostatic pressure of the drilling fluid in the well bore would exceed the formation pressure in certain cases if too much open hole portion is exposed. The drilling fluid weight is selected to be sufficiently greater than the pressures in the various earth formations to avoid a blowout. This weight may be excessive for low pressure formations located uphole in the well and not protected by casing. Drilling fluid may flow into the low pressure formations, which is not desired. In many cases, the use of one low pressure wellhead housing, one high pressure wellhead housing, and multiple strings of casing will be sufficient to adequately protect low pressure water zones in the well.

There are geographic areas, however, in which more casing than normal would be required to protect low pressure water zones. Running an additional casing hanger and string of casing may not always be feasible because of the shallow depth of the low pressure water zone. Also, additional casing strings result in the final production string possibly being smaller than desired.

It has been proposed by others to utilize an additional wellhead housing, resulting in an outer, intermediate, and inner wellhead housing. However, running an inner wellhead housing, without modification, creates problems. Wellhead housings do not have flowby slots on the exterior like casing hangers. Wellhead housings do not have packoffs or seals located between them. Consequently, an inner wellhead housing located within an intermediate wellhead housing would not have any passage for cement returns to flow.

SUMMARY OF THE INVENTION

In this invention, an intermediate wellhead housing is positioned between the low pressure and high pressure wellhead housings. The intermediate wellhead housing will be installed and cemented in a conventional manner, with cement returns preferably through a port in the outer wellhead housing.

The inner wellhead housing will have a port extending through its sidewall. A sleeve opens and closes the port. During cementing of the inner casing, the cement returns will flow up the annulus surrounding the inner casing, through the port and up the bore of the inner wellhead housing. Then, the running tool is pulled up to close the sleeve and the port. Subsequently a casing hanger will be landed in the inner wellhead housing.

BRIEF DESCRIPTION OF THE DRAWINGS

FIGS. 1*a* and 1*b* are a quarter sectional view illustrating a subsea well assembly constructed in accordance with this invention, and showing the inner casing in the process of being cemented in place.

FIGS. 2*a* and 2*b* are a quarter sectional view of the subsea well assembly of FIG. 1, showing the inner casing being flushed after cementing.

DETAILED DESCRIPTION OF THE INVENTION

Referring to the figures, outer wellhead housing 11 is conventional, being a large tubular member secured to a string of conductor or outer casing 13. Outer casing 13 will extend into the well to a selected depth and be cemented in place. In the embodiment shown, outer wellhead housing 11 has two axially spaced apart landing shoulders 15, 17 in its interior. Each landing shoulder 15, 17 is a tapered conical surface. A latch assembly 19 mounts to the upper rim of outer wellhead housing 11.

An intermediate wellhead housing 21 will land in the outer wellhead housing 11. Intermediate wellhead housing 21 lands and seals on the internal landing shoulders 15, 17. A string of intermediate casing 23 secures to intermediate wellhead housing 21 and extends into the well to a greater depth than outer casing 13. The operator cements intermediate casing 23 by pumping cement down the intermediate casing 23, and returning it up the annulus surrounding intermediate casing 23. In the embodiment shown, the cement returns flow out a return port 25 located in outer wellhead housing 11.

Intermediate wellhead housing 21 has two axially spaced apart landing shoulders 27, 29 that are of the same general configuration as landing shoulders 15, 17. Landing shoulders 27, 29 are tapered conical surfaces. An inner or high pressure wellhead housing 31 will land in the intermediate wellhead housing 21. Inner wellhead housing 31 has an axial bore 33 and a pair of external landing shoulders 35, 36. The landing shoulders 35, 36 are conical for mating with the landings shoulders 27, 29. The external landing shoulders 35, 36 have seals 34 so as to block any flow upward past the lowermost landing shoulder 35 into the space between the inner wellhead housing 31 and the intermediate wellhead housing 21.

A string of inner casing 37 secures to the lower end of inner wellhead housing 31 and extends to a greater depth in the well than the intermediate casing 23. An annulus 38 will exist between the inner casing 37 and the intermediate casing 23. Normally, the annulus 38 would be blocked at the top by the seals 34 at the shoulders 27, 35. Without some provision, there would be no means for cement returns to circulate up annulus 38 while the inner casing 37 is being cemented.

Circulation is allowed in this instance by ports 39 being provided through inner wellhead housing 31. Port 39 comprises one or more passages extending radially through the sidewall of inner wellhead housing 31 below the landing shoulder 35. Port 39 communicates annulus 38 with the inner wellhead housing bore 33.

Inner wellhead housing 31 further has a set of exterior grooves 41 (FIG. 1*a*) located near the upper end. Exterior grooves 41 form a profile adapted to receive a wellhead connector (not shown). The wellhead connector will connect to the inner wellhead housing 31 a riser which extends upward to a drilling vessel. Additionally, inner wellhead housing 31 has a set of internal grooves 43 located near its upper end. Internal grooves 43 provide a profile for running the inner wellhead housing 31, as will be subsequently described. Further, inner wellhead housing 31 is held in intermediate wellhead housing 21 by a latch assembly 44 located on the upper end of intermediate wellhead housing 21.

A sleeve 45 serves as means to open and close port 39. Sleeve 45 is carried in bore 33 for axial as well as rotational movement relative to inner wellhead housing 31. Sleeve 45 has one or more ports 47 extending through it for communicating with port 39. Port 47 will axially align with port 39 when sleeve 45 is in the open position shown in FIG. 1*b*. When sleeve 45 moves to the closed position shown in FIG. 2*b*, sleeve port 47 will be spaced above port 39, blocking flow. Seals 48 are located on the exterior of sleeve 45 and axially spaced apart for sealing port 39 when sleeve 45 is in the closed position.

The means for moving sleeve 45 between the open and closed positions includes a set of threads 49 formed on the exterior of sleeve 45. Threads 49 engage threads 51 formed in bore 33 of inner wellhead housing 31. Rotating sleeve 45 will cause sleeve 45 to move up and down due to the engagement of threads 49, 51. The upper edge of sleeve 45 forms a landing seat 52 for receiving a casing hanger (not shown) after installation of the inner wellhead housing 31 has been completed.

A running tool 53 cooperates with sleeve 45 to move sleeve 45 between the open and closed positions. Running tool 53, as shown in FIG. 1*a*, includes a tubular axially extending mandrel 55. The upper end of mandrel 55 is threaded (not shown) for connection to a string of drill pipe extending to a drilling vessel. The lower end of mandrel 55 connects to a pipe 57 which extends into inner casing 37 to a conventional cement device for delivering cement to the annulus surrounding inner casing 37.

Running tool 53 has means at its upper end for engaging inner wellhead housing 31 to lower inner wellhead housing 31 into intermediate wellhead housing 21. This engaging means includes a carrier 59 which secures by threads 61 to threads 63 formed on the exterior of mandrel 55. Rotating mandrel 55 relative to carrier 59 will cause mandrel 55 to move axially relative to carrier 59 because of the threads 61, 63.

A locking member, preferably a set of dogs 65, is carried by carrier 59. Dogs 65 will move radially between a retracted position, shown in FIG. 2*a* and an extended position shown in FIG. 1*a*. In the extended, or gripping position, dogs 65 will engage the grooved profile 43 in bore 33 of inner wellhead housing 31. A plurality of passages 67 extend through carrier 59 to allow fluid flow up the bore 33 of inner wellhead housing 31.

The means for moving the dogs 65 from the retracted position to the engaged position includes a cam 69 formed on the exterior of mandrel 55. A recess 70 locates on the exterior of mandrel 55 directly below cam 69. In the retracted position, the dogs 65 will slide into the recess 70.

Running tool 53 also has a body 71 for engaging the sleeve 45. Body 71 mounts to mandrel 55 for movement therewith. Body 71 locates below carrier 59 and has a plurality of splines 73 (FIG. 2*b*) for engaging mating splines in the interior of sleeve 45. A downward facing shoulder 74 (FIG. 2*b*) locates at the upper end of splines 73. The landing seat 52 on the upper edge of sleeve 45 engages the shoulder 74. Rotating sleeve 45 with body 71 causes the sleeve 45 to move upward due to threads 49, 51. The sleeve 45 will lift the body 71 and mandrel 55 along with it because of shoulder 74.

Body 71 has a flow passage 75 that will communicate with sleeve port 47 when body 71 engages sleeve 45. Body passage 75 extends radially inward from port 47, then upward at a 90 degree angle, with the exit being located on the upper end of body 71. This provides a flow path from annulus 38, through port 39, port 47, and passage 75 to bore 33 of inner wellhead housing 31. A seal 77 located on the upper end of body 71 prevents the entry of debris into the threaded area around threads 49 and 51.

In operation, the operator will install the outer wellhead housing 11 and intermediate wellhead housing 21 in conventional manners. The operator will drill through the intermediate casing 23 to a desired depth. The operator will then make up a string of inner casing 37 and lower it into the intermediate casing 23. The operator secures inner wellhead housing 31 to the upper end of inner casing 37. The operator secures running tool 53 to a string of drill pipe 57 and positions the mandrel 55 so that dogs 65 will engage grooves 43 (FIG. 1*a*). At the same time, body 71 through splines 73 will engage sleeve 45. Sleeve 45 will be in the open position shown in FIG. 1*b*.

The operator then lowers the entire assembly into the well, including the inner casing 37 and inner wellhead housing 31. The operator will land the inner wellhead housing 31 on the landing shoulders 27, 29. The latch assembly 44 will latch the inner wellhead housing 31 in place. The running tool 53 may include additional structure (not shown) for applying a downward force on the inner wellhead housing 31 to assure that it seats tightly within the intermediate wellhead housing 21.

The operator then pumps cement down the pipe 57 to flow up the annulus 38. Cement will flow through ports 39, 47 and out passage 75 into bore 33 of inner wellhead housing 31. The cement flows through passage 67 in carrier 59 out of the inner wellhead housing 31.

Once cementing has been completed, the operator will rotate mandrel 55. The body 71 will rotate with mandrel 55. The carrier 59 will not rotate with mandrel 55. The body 71 will cause the sleeve 45 to rotate. Threads 49, 51 will cause the sleeve 45 to move upward. This upward movement eventually closes the port 39 and seals it with seals 48. The rotation also causes mandrel 55 to move upward because of the engagement of sleeve landing seat 52 with shoulder 74 in sleeve 45. As mandrel 55 moves upward, the cam 69 will move above the dogs 65, placing the recess 70 behind the dogs 65. This allows the dogs 65 to retract to the position shown in FIG. 2*a*.

The pipe 57 will have moved upward along with the upward movement of mandrel 55. This disengages the lower end of pipe 57 from the cementing device (not shown). The operator may then pump fluid down the pipe 57. The fluid will then flow back up the inner casing 37. The fluid flows through clearances in the splines 73 and out the body passage 75. The fluid will flow up the bore 33 of inner wellhead housing 31. This procedure flushes the interior of inner casing 37 and the bore 33 of cement returns.

Once flushing is completed, the operator pulls the running tool 53 back to the drilling vessel. Normally, the operator would then drill through the inner casing 37 to a greater depth. He would then run another string of casing (not shown). A casing hanger (not shown) would land on landing seat 52. After cementing, a seal would be installed between the casing hanger and the bore 33 of wellhead housing 31.

The invention has significant advantages. The porting allows three wellhead housings to be utilized, with cement returns to flow through the bore of the innermost wellhead housing. This allows the operator to utilize additional strings of casing to protect low pressure water zones.

While the invention has been shown in only one of its forms, it should be apparent to those skilled in the art that it is not so limited, but is susceptible to various changes without departing from the scope of the invention.

We claim:

1. A subsea well assembly of a type having an outer wellhead housing secured to the upper end of a string of outer casing, an inner wellhead housing being secured to a string of inner casing and having a bore and an external landing shoulder, the improvement comprising in combination:

an intermediate wellhead housing, having an external landing shoulder that lands in the outer wellhead housing and an internal landing shoulder that engages and supports the external landing shoulder of the inner wellhead housing, the intermediate wellhead housing being secured to a string of intermediate casing, defining an annulus between the string of inner casing and the string of intermediate casing;

a port extending through the inner wellhead housing below the external landing shoulder of the inner wellhead housing, communicating the annulus with the bore of the inner wellhead housing; and a sleeve mounted to the inner wellhead housing for movement relative to the inner wellhead housing between an open position opening the port to allow cement returns up the annulus and through the bore of the inner wellhead housing, and a closed position closing the port once cementing has been completed.

2. The well assembly according to claim 1 wherein the inner wellhead housing protrudes above the intermediate wellhead housing and has a grooved profile on its exterior for receiving a wellhead connector.

3. The well assembly according to claim further comprising a landing seat located in the bore of the inner wellhead housing for receiving and supporting a casing hanger secured to a smaller diameter string of casing than the string of inner casing.

4. The well assembly according to claim 1 wherein the engagement of the internal landing shoulder of the intermediate wellhead housing with the external landing shoulder of the inner wellhead housing prevents the flow of any cement between the intermediate and inner wellhead housings above the internal landing shoulder of the intermediate wellhead housing.

5. A subsea well assembly of a type having an outer wellhead housing secured to the upper end of a string of outer casing, the improvement comprising in combination:

an intermediate wellhead housing which lands in the outer wellhead housing and has an internal landing shoulder, the intermediate wellhead housing being secured to a string of intermediate casing that extends into the outer casing;

an inner wellhead housing having a bore, an external landing shoulder that engages the internal landing shoulder of the intermediate wellhead housing and being secured to a string of inner casing, the inner casing extending into the intermediate casing, defining an annulus which is blocked against flow at its upper end by the engagement of the internal landing shoulder with the external landing shoulder, the inner wellhead housing protruding above the intermediate wellhead housing and having a grooved profile on its exterior for receiving a wellhead connector;

a port extending through the inner wellhead housing below the external landing shoulder of the inner wellhead housing, communicating the annulus with the bore of the inner wellhead housing;

a sleeve;

mounting means for mounting the sleeve to the inner wellhead housing for axial movement relative to the inner wellhead housing between an open position opening the port to allow cement returns up the annulus and through the bore of the inner wellhead housing, and a closed position closing the port once cementing has been completed; and a landing seat located in the bore of the inner wellhead housing for receiving a casing hanger secured to a string of casing having a lesser diameter than the diameter of the string of inner casing.

6. The well assembly according to claim 5 wherein the mounting means comprises a set of external threads on the sleeve which engage a set of internal threads in the bore such that rotation of the sleeve causes the sleeve to move axially relative to the inner wellhead housing.

7. The well assembly according to claim 5 wherein the sleeve has a port that communicates with the port in the inner wellhead housing when the sleeve is in the open position.

8. The well assembly according to claim 5 wherein the landing seat is located on the sleeve.

9. An apparatus for supporting and installing a string of inner casing in a subsea well of the type having an outer wellhead housing secured to the upper end of a string of outer casing, comprising in combination:

an intermediate wellhead housing which lands in the outer wellhead housing and has an internal landing shoulder, the intermediate wellhead housing being secured to a string of intermediate casing that extends into the outer casing;

an inner wellhead housing having a bore, an external landing shoulder that engages the internal landing shoulder of the intermediate wellhead housing and is secured to the string of inner casing, the inner casing extending into the intermediate casing, defining an annulus which is blocked against flow at its upper end by the engagement of the internal landing shoulder with the external landing shoulder, the inner wellhead housing protruding above the intermediate wellhead housing and having a grooved profile on its exterior for receiving a wellhead connector;

a port extending through the inner wellhead housing below the external landing shoulder of the inner wellhead housing, communicating the annulus with the bore of the inner wellhead housing;

a sleeve;

mounting means for mounting the sleeve to the inner wellhead housing for axial movement relative to the inner wellhead housing between an open position opening the port to allow cement returns up the annulus and through the bore of the inner wellhead housing, and a closed position closing the port once cementing has been completed;

running tool means for engaging and lowering the inner wellhead housing into the intermediate wellhead housing and for moving the sleeve between the open and closed positions; and a landing seat located in the bore of the inner wellhead housing for receiving a casing hanger secured to a string of casing having a lesser diameter than the diameter of the string of inner casing.

10. The apparatus according to claim 9 wherein the running tool means comprises:

a mandrel having an upper end adapted to be secured to a string of pipe extending upward to a drilling platform;

engaging means mounted to the mandrel for engaging an upper end of the inner wellhead housing to support the weight of the inner wellhead housing and the string of inner casing; and a body mounted to the mandrel below the engaging means and adapted to engage the sleeve for moving the sleeve between the open and closed positions by manipulation of the mandrel.

11. The apparatus according to claim 9 wherein the inner wellhead housing has a grooved profile in the bore and wherein the running tool means comprises:

a mandrel having an upper end adapted to be secured to a string of pipe extending upward to a drilling platform;

an engaging member mounted to the mandrel for movement between retracted and engaging positions in engagement with the grooved profile in the bore;

means mounted to the mandrel for moving the engaging member between the retracted and engaging positions by axial movement of the mandrel; and a body mounted below the engaging member for engaging the sleeve to move the sleeve from the open position to the closed position while the mandrel moves the engaging member from the engaging position to the retracted position.

12. The apparatus according to claim 9 wherein:

the inner wellhead housing has a grooved profile in the bore; wherein the mounting means comprises a set of external threads on the sleeve which engage a set of internal threads in the bore such that rotation of the sleeve causes the sleeve to move axially relative to the inner wellhead housing;

and wherein the running tool means comprises:

a mandrel having an upper end adapted to be secured to a string of pipe extending upward to a drilling platform;

an engaging member mounted to the mandrel for movement between retracted and engaging positions in engagement with the grooved profile in the bore;

a cam mounted to the mandrel for moving the engaging member between the retracted and engaging positions by rotational and axial movement of the mandrel; and a body mounted below the engaging member, having an external spline for engaging the sleeve to rotate the sleeve when the mandrel is rotated to move the sleeve from the open position to the closed position while the mandrel moves the engaging member from the engaging position to the retracted position.

13. The apparatus according to claim 9 wherein:

the sleeve has a port that communicates with the port in the inner wellhead housing when the sleeve is in the open position; and wherein the running tool means comprises:

a mandrel having an upper end adapted to be secured to a string of pipe extending upward to a drilling platform;

engaging means mounted to the mandrel for engaging an upper end of the inner wellhead housing to support the weight of the inner wellhead housing and string of inner casing; and a body mounted to the mandrel below the engaging means and adapted to engage the sleeve for moving the sleeve between the open and closed positions by manipulation of the mandrel, the body having a passage that communicates with the port in the sleeve to allow cement returns to flow through the passage in the body and into the bore of the inner wellhead housing.

* * * * *

UNITED STATES PATENT AND TRADEMARK OFFICE

CERTIFICATE OF CORRECTION

PATENT NO. : 5,188,181

DATED : 02/23/93

INVENTOR(S) : Norman Brammer, et al.

It is certified that error appears in the above-identified patent and that said Letters Patent is hereby corrected as shown below:

At column 6, line 3, the numeral "1" follows the word "claim".

Signed and Sealed this

Eighth Day of March, 1994

*Attest:*

Bruce Lehman

BRUCE LEHMAN

*Attesting Officer*

*Commissioner of Patents and Trademarks*